US011774090B2

(12) United States Patent
Garcia et al.

(10) Patent No.: US 11,774,090 B2
(45) Date of Patent: Oct. 3, 2023

(54) DOUBLE-STACKED GAS BURNER

(71) Applicant: Electrolux Home Products, Inc., Charlotte, NC (US)

(72) Inventors: Andre Garcia, Hendersonville, TN (US); Michael D. Padgett, Springfield, TN (US); Fabio Rasi, Forlì (IT); Areli Uribe Portugal, Forlì (IT)

(73) Assignee: Electrolux Home Products, Inc., Charlotte, NC (US)

( * ) Notice: Subject to any disclaimer, the term of this patent is extended or adjusted under 35 U.S.C. 154(b) by 332 days.

(21) Appl. No.: 17/149,682

(22) Filed: Jan. 14, 2021

(65) Prior Publication Data

US 2022/0221146 A1 Jul. 14, 2022

(51) Int. Cl.
*F23D 14/06* (2006.01)
*F24C 3/08* (2006.01)

(52) U.S. Cl.
CPC ..... *F23D 14/06* (2013.01); *F24C 3/085* (2013.01); *F23D 2900/14003* (2013.01); *F23D 2900/14063* (2013.01)

(58) Field of Classification Search
CPC ..... F23D 14/06; F24C 3/085
USPC ..... 126/39 E, 39 R
See application file for complete search history.

(56) References Cited

U.S. PATENT DOCUMENTS 6,332,460 B1 12/2001 Paesani
2006/0051718 A1 3/2006 Kamal et al.
2009/0047611 A1* 2/2009 Armanni ..... F23D 14/065 126/39 R
2015/0219340 A1* 8/2015 Cadima ..... F24C 3/10 126/39 E
2019/0242583 A1* 8/2019 Paller ..... F24C 3/085
2020/0370747 A1 11/2020 Knight et al.
2021/0270458 A1* 9/2021 Turchi ..... F24C 3/085

FOREIGN PATENT DOCUMENTS

GB 1370326 10/1974

OTHER PUBLICATIONS

International Search Report and Written Opinion for PCT/US2021/063726, dated Mar. 29, 2022, 15 pages.

* cited by examiner

*Primary Examiner* — Vivek K Shirsat
(74) *Attorney, Agent, or Firm* — Pearne & Gordon LLP

(57) ABSTRACT

A gas burner assembly for a cooktop appliance including an upper chamber, a first plurality of burner ports, a lower chamber and a second plurality of burner ports. A first fuel-gas injector is configured to direct a first stream of fuel gas into the upper chamber, thereby drawing surrounding air to yield injection of a first mixture of fuel gas and air into the upper chamber. A second fuel-gas injector directs a second stream of fuel gas into a secondary opening that communicates with the lower chamber, thereby drawing surrounding air to yield injection of a second mixture of fuel gas and air into the lower chamber. The upper chamber being isolated from the lower chamber so that the first mixture of fuel gas and air in the upper chamber does not mix with the second mixture of fuel gas and air in the lower chamber.

18 Claims, 15 Drawing Sheets

DOUBLE-STACKED GAS BURNER

FIELD OF THE INVENTION

The present invention relates to gas burners for a cooktop appliance, and more particularly, to a top-breathing, double-stacked gas burner assembly with a main burner flame exiting an upper chamber and a simmer burner flame exiting a separate, lower chamber.

BACKGROUND OF THE INVENTION

Gas cooktop appliances often have one or more gas burners. The gas burners are designed to mix fuel gas with air and then ignite the mixture to generate a flame. Many gas burners are top-breathing, meaning that they draw air from above a cooktop surface of the appliance. However, the flames produced by these gas burners are susceptible to being extinguished, often referred to as "flame out," due to changes in the environment (e.g., pressure waves). Such changes can cause the flame produced by the burner to detach or "lift off" the face of the burner and become extinguished. During flame out, combustible gas supplied to the burner continues to emanate from the burner, which can be undesirable.

Some conventional gas burners include retention flame burner ports that are configured to reignite the air-fuel mixture emanating from main burner ports during flame out. The retention flame burner ports in some gas burners also function as "simmer" burner ports when heating cookware at a low power rating. In these conventional gas burners, the main burner ports and the simmer ports are supplied from the same mixing chamber in the burner. Drawing from the same mixing chamber limits the volume of the air-fuel mixture that may be supplied to the simmer burner ports thereby causing the retention flames to be more likely extinguished when operating at low power settings.

Therefore, it is desirable to have a gas burner that can sustain retention flames at low power settings.

SUMMARY OF THE INVENTION

There is provided a gas burner assembly for a cooktop appliance. The gas burner assembly includes an upper chamber, a first plurality of burner ports communicating with the upper chamber, a lower chamber isolated from the upper chamber and a second plurality of burner ports communicating with the lower chamber. A first fuel-gas injector is configured to direct a first stream of fuel gas into a first opening that communicates with the upper chamber, thereby drawing surrounding air to be combined therewith in the first opening to yield injection of a first mixture of fuel gas and air into the upper chamber, to flow out the first plurality of burner ports. A second fuel-gas injector directs a second stream of fuel gas into a secondary opening that communicates with the lower chamber, thereby drawing surrounding air to be combined therewith in the secondary opening to yield injection of a second mixture of fuel gas and air into the lower chamber, to flow out the second plurality of burner ports. The upper chamber being isolated from the lower chamber so that the first mixture of fuel gas and air in the upper chamber does not mix with the second mixture of fuel gas and air in the lower chamber.

The is also provided a gas burner assembly for a cooktop appliance. The gas burner assembly includes a lower body having a pass-through opening and a secondary opening extend between an upper surface and a lower surface of the lower body. An intermediate body rests on the lower body and includes a first opening extending between the upper surface and the lower surface. The first opening of the intermediate body is aligned with the pass-through opening of the lower body. The lower surface of the intermediate body and the upper surface of the lower body at least partially defining a lower chamber of the gas burner assembly. The secondary opening of the lower body defines an inlet to the lower chamber. At least one of the lower body and the intermediate body define a simmer burner port fluidly communicating with the lower chamber. A cap is positioned on the intermediate body and includes a top planar wall and a peripheral side wall. The peripheral side wall includes a main burner port of the gas burner assembly. The top planar wall and the peripheral side wall of the cap and the upper surface of the intermediate body define an upper chamber of the gas burner assembly. The first opening of the intermediate body defines an inlet to the upper chamber. The main burner port fluidly communicates with the upper chamber.

BRIEF DESCRIPTION OF THE DRAWINGS

Preferred embodiments are disclosed and described in detail herein with reference to the accompanying drawings which form a part hereof, and wherein.

DETAILED DESCRIPTION OF PREFERRED EMBODIMENTS

Figure 1:
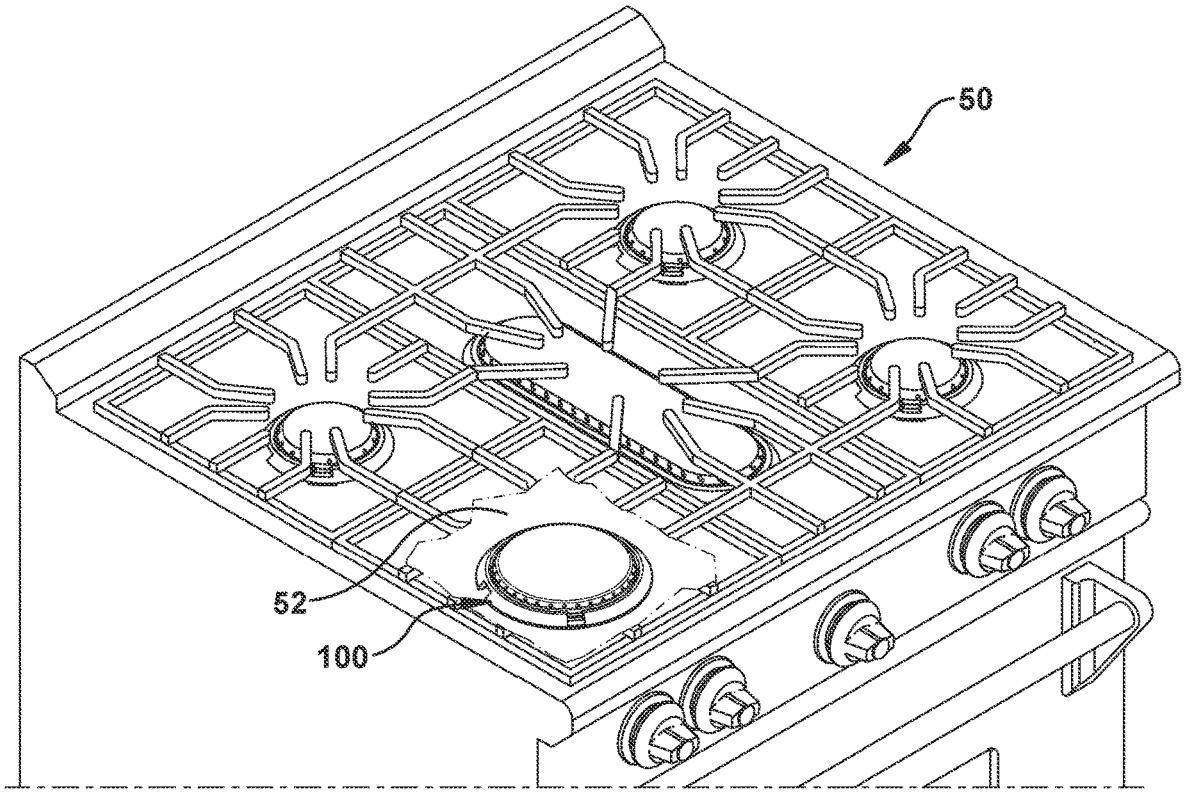
FIG. 1 is a perspective view of a gas range having a plurality of gas burners disposed thereon.
Figure 2:
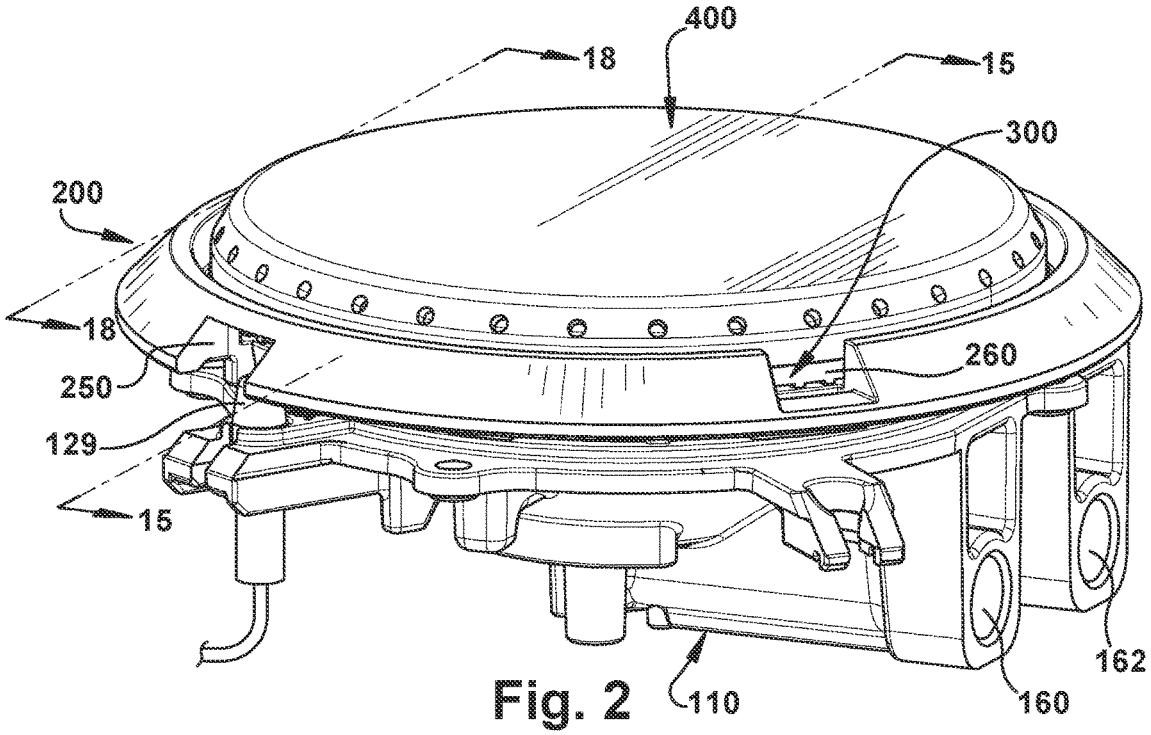
FIG. 2 is a perspective view of an example double-stacked gas burner assembly as herein disclosed.
Figure 3:
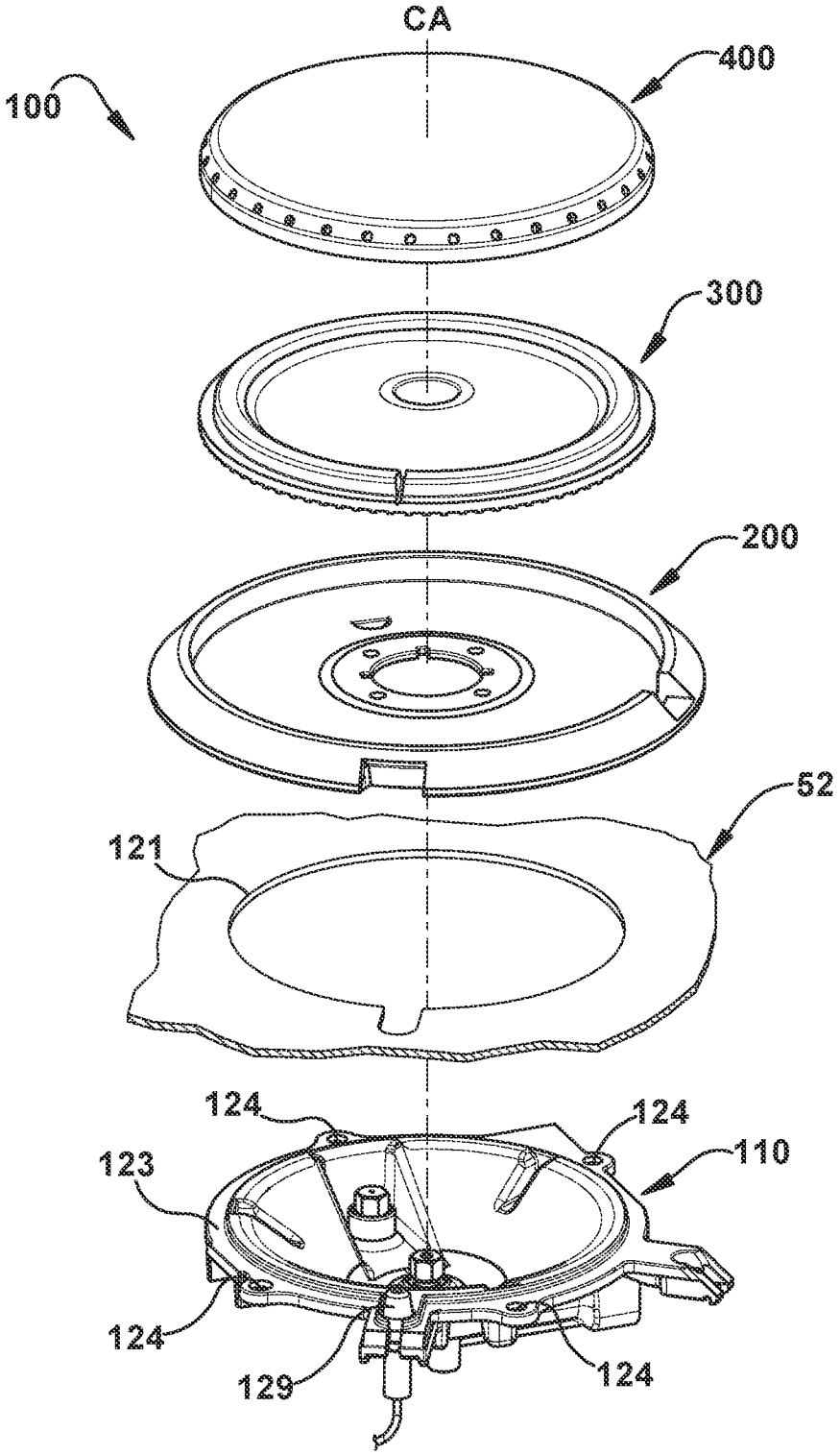
FIG. 3 is an exploded, perspective view of a gas burner assembly in relation to a cooktop panel of a gas range, having an intermediate body and a lower body according to a first embodiment.

Referring now to the drawings, FIG. 1 shows a gas cooktop appliance in the form of a domestic range, indicated generally at 50. Although the detailed description that follows concerns a domestic range 50, the burners described herein can be incorporated into gas cooktop ranges other than a domestic range 50, as well as in stand-alone gas cooktops (or hobs) that are designed to be mounted in a countertop and not as part of a full range. In the illustrated embodiment, the range 50 includes a gas burner assembly 100. Referring to FIGS. 2 and 3, the gas burner assembly 100, in general, according to a first embodiment includes an orifice holder 110, a lower body 200, an intermediate body 300, and a cap 400.

Figure 4:
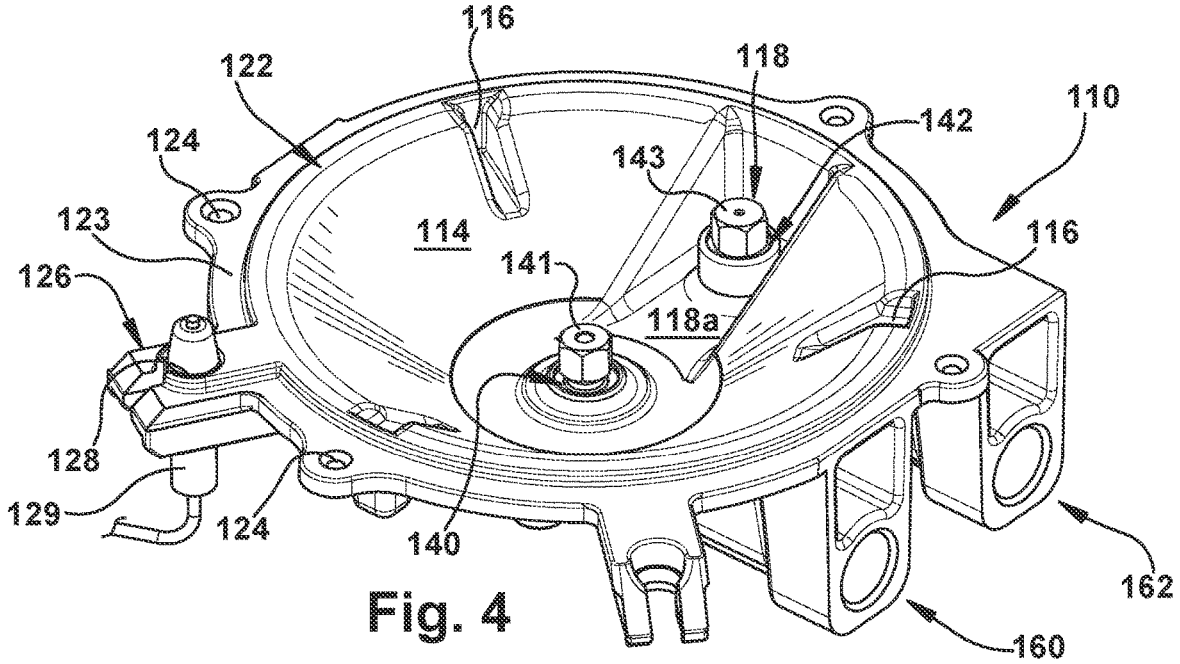
FIG. 4 is a top perspective view of an orifice holder of the gas burner assembly of FIG. 2.
Figure 15:
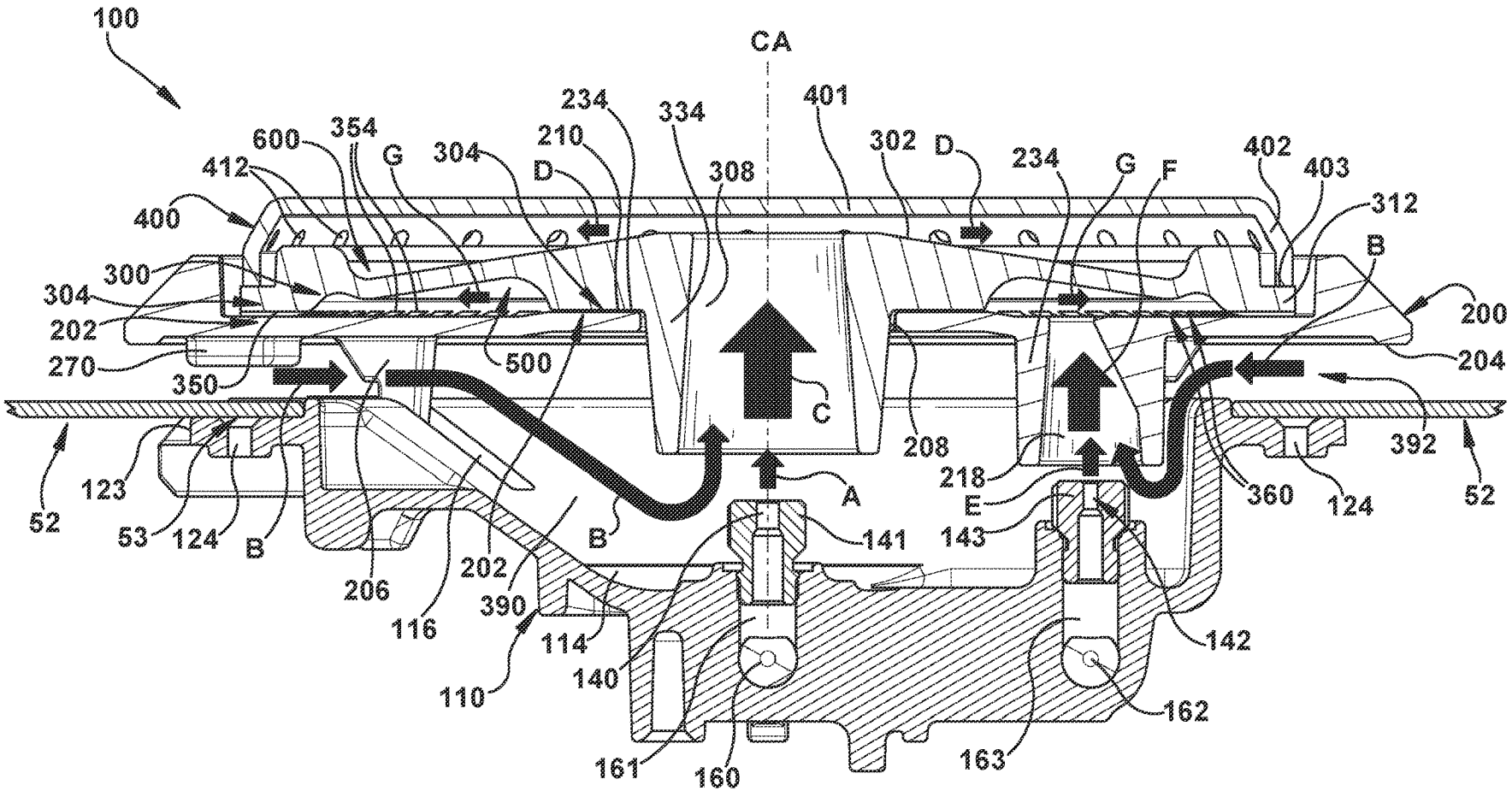
FIG. 15 is a side section view of the gas burner assembly of FIG. 2 taken along line 15-15 of FIG. 2.

Referring to FIG. 4, the orifice holder 110 includes a contoured bowl 114, a first gas inlet port 160, and a second gas inlet port 162. The contoured bowl 114 is formed in an upper surface of the orifice holder 110. A plurality of seats 116 are formed in a side wall of the contoured bowl 114. Each seat 116 is positioned and dimensioned to accommodate therein and engage with a portion or protrusion of the lower body 200, such as legs 206 as described in detail below. A first gas outlet port 140 extends through a central portion of the bowl 114 and is fluidly connected to the first gas inlet port 160 via a first internal passage 161 (FIG. 15). The first gas outlet port 140 is dimensioned to receive a first gas nozzle 141.

A recess 118 is formed in the side wall of the contoured bowl 114. The recess 118 includes a bottom surface 118*a* and a second gas outlet port 142 formed in the bottom surface 118*a*. The second gas outlet port 142 is fluidly connected to the second gas inlet port 162 via a second internal passage 163 (FIG. 15). The second gas outlet port 142 is dimensioned to receive a second gas nozzle 143.

Referring back to FIG. 3, a contoured opening 121 is formed in a cooktop panel 52 of the range 50. The opening 121 is shaped and dimensioned to correspond to an upper opening or mouth of a contoured portion 122 (FIG. 4) of the orifice holder 110. The orifice holder 110 is positioned or suspended below the cooktop panel 52 such that the contoured portion 122 (FIG. 4) is substantially aligned with and extends below the opening 121 in the cooktop panel 52. It is contemplated that an upper perimeter rim or surface of the contoured portion 122 (FIG. 4) may be flush with an upper surface of the cooktop panel 52.

Referring back to FIG. 4, a plurality of countersunk mounting holes 124 are formed along a recessed ledge 123 of the orifice holder 110. The mounting holes 124 are dimensioned and positioned to align with holes (not shown) in a substructure (not shown) of the range 50 (FIG. 1), as described in detail below. It is also contemplated that the mounting holes 124 may be dimensioned and positioned to align with holes (not shown) in the cooktop panel 52 such that fasteners (not shown) may secure the orifice holder 110 to a bottom surface of the cooktop panel 52. A tab 126 extends from one side of the orifice holder 112 and includes an opening 128 therein for receiving a spark ignitor 129. The spark ignitor 129 is configured to generate a spark upon command to ignite an air-fuel mixture exiting the gas burner assembly 100, as described in detail below.

Figure 5:
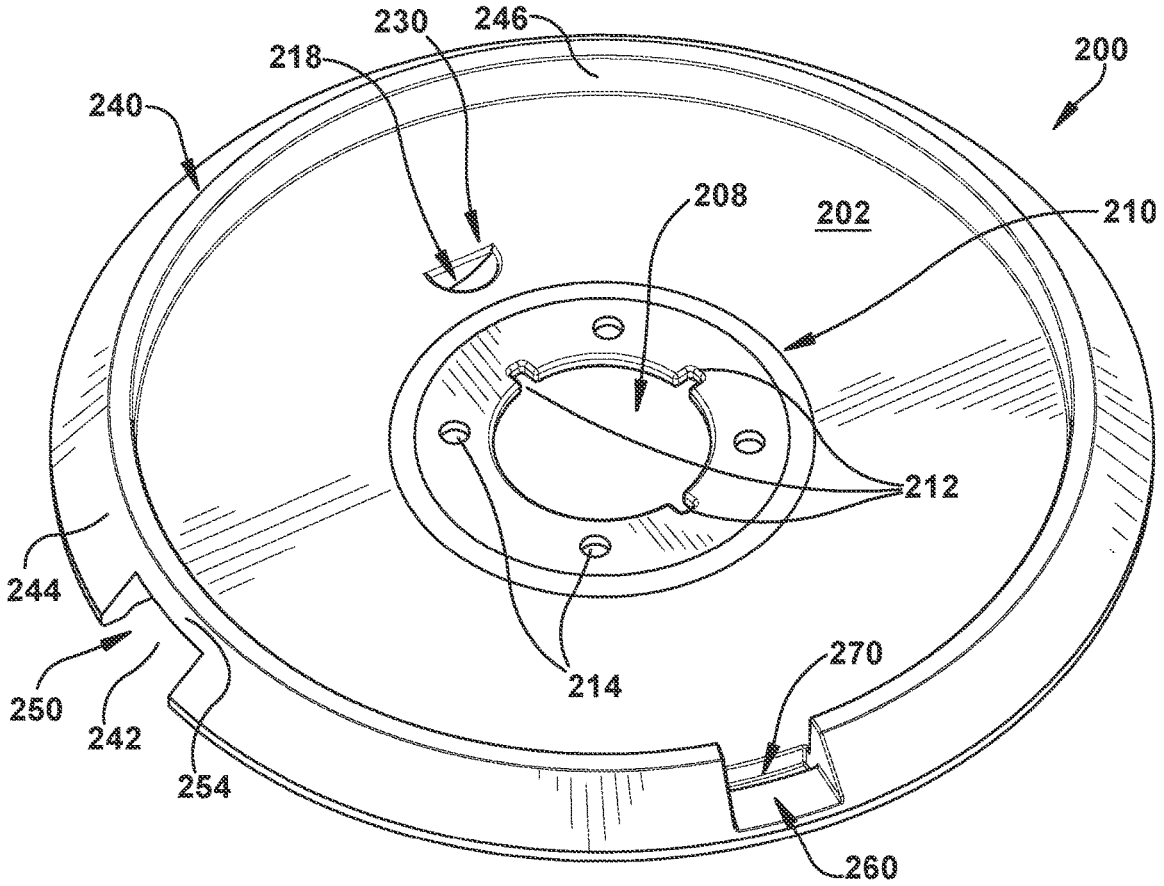
FIG. 5 is a top perspective view of a lower body of the gas burner assembly of FIG. 2.
Figure 6A:
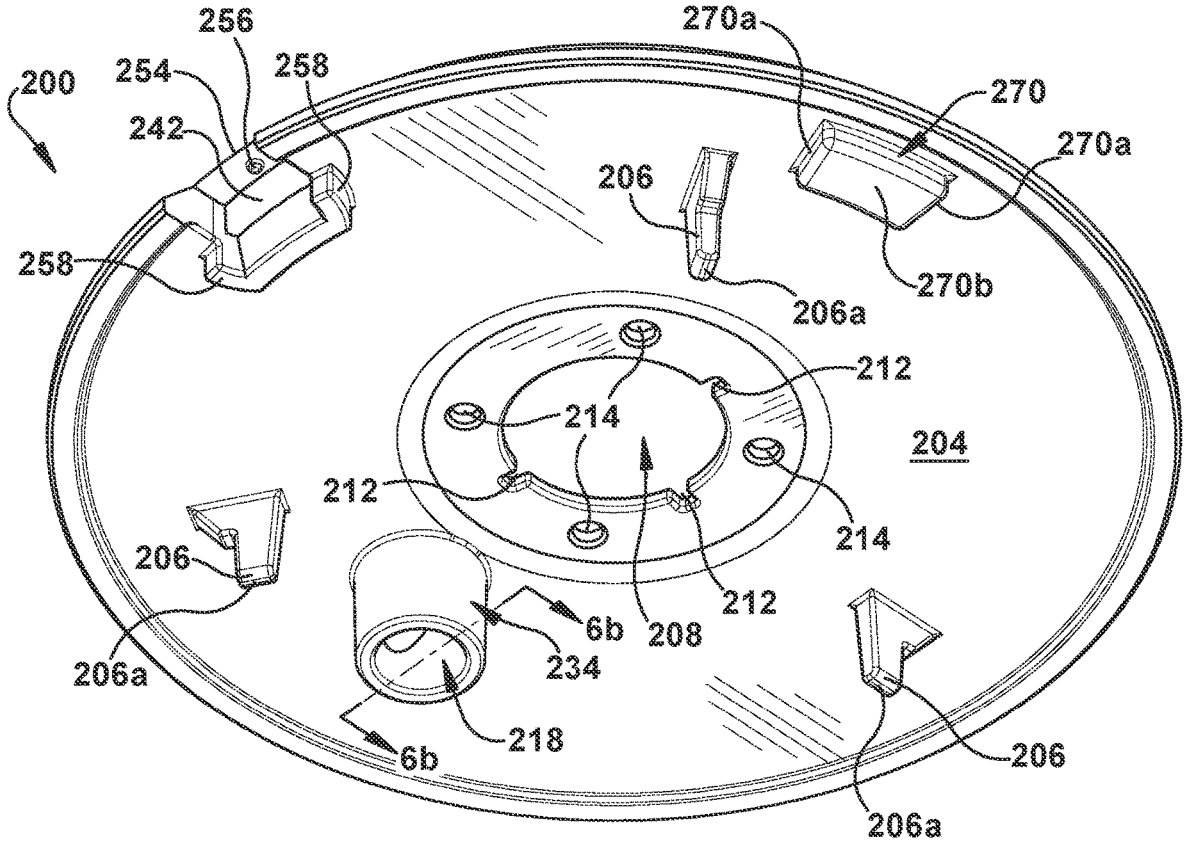
FIG. 6*a* is a bottom perspective view of the lower body of FIG. 5.

Referring to FIG. 5, the lower body 200 (according to the first embodiment) includes an upper surface 202, a lower surface 204 (FIG. 6*a*), and a pass-through opening 208 extending through a central portion of the lower body 200 between the upper surface 202 and the lower surface 204 (FIG. 6*a*). The upper surface 202 may include a raised annular portion 210 formed around the pass-through opening 208. Notches 212 may be disposed about an outer periphery of the pass-through opening 208. In the illustrated embodiment, there are three notches 212. It is contemplated that the notches 212 may be different in shape, number, and location. Mounting holes 214 may extend through the lower body 200 between the upper surface 202 and the lower surface 204 (FIG. 6*a*). In the embodiment shown, the mounting holes 214 are formed in the raised annular portion 210 and there are four mounting holes 214. It is contemplated that the mounting holes 214 could be different in number and location.

An upwardly extending flange 240 is disposed about an outer periphery of the upper surface 202. The flange 240 defines a recessed area that is dimensioned to receive and accommodate the intermediate body 300, as described in detail below. In the embodiment shown, the flange 240 includes a sloped outer wall 244 and a generally vertical inner wall 246. A first notch 250 extends through the flange 240 and defines a generally rectangular-shaped passageway or opening 242 leading to an underside of the lower body 200. The flange 240 also includes a second notch 260 that is positioned above a stability chamber 270, and leading to an upper side of the lower body 200.

Referring to FIG. 6*a*, the stability chamber 270 is a generally box-shaped, recessed cavity extending from the lower surface 204 of the lower body 200. The stability chamber 270 is defined by downwardly extending side walls 270*a* and a bottom wall 270*b*. Downwardly extending side walls 258 are also formed around the opening 242 formed in the flange 240. A bridge 254 extends over the opening 242 and includes a spark target 256 on a bottom surface of the bridge 254.

A plurality of legs 206 extend from the lower surface 204 of the lower body 200. The legs 206 are dimensioned and positioned to rest on or within the seats 116 (FIG. 4) in the orifice holder 110 (FIG. 4), as described in detail below. In the embodiment shown, there are three legs 206 each including a projecting portion 206*a*. It is contemplated that more than three legs 206 may extend from the lower surface 204 and the legs 206 may have other shapes.

Figure 6B:
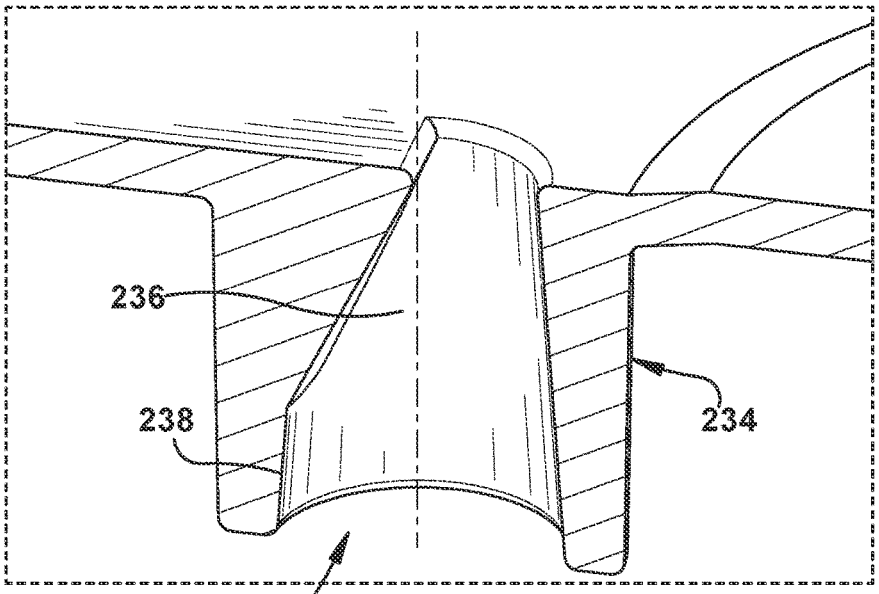
FIG. 6*b* is a closeup section view of a boss extending from a lower surface of the lower body of FIG. 5 taken along line 6*b*-6*b* of FIG. 6*a;*

A boss 234 extends from the lower surface 204 of the lower body 200, and a secondary opening 218 of the lower body 200 extends through the boss 234 to the upper surface 202. In the embodiment shown, the secondary opening 218 is radially offset relative to the pass-through opening 208 of the lower body 200. Referring to FIG. 6*b*, the secondary opening 218 may be substantially frustoconical such that its interior diameter generally decreases from the lower end of the boss 234 to its upper end where the opening 218 opens to the upper surface 202 (FIG. 5). Moreover, the secondary opening 218 also may include a chamfered wall portion 236*a* inclined radially inward from a lower end thereof up to its upper end adjacent to the upper surface 202 (FIG. 5), resulting in the opening 218 appearing semi-circular 230 from above the upper surface 202 (FIG. 5). The resulting secondary opening 218 is uniformly frustoconical at a lower portion 238 thereof, and substantially frustoconical at an upper portion 236 thereof wherein one wall segment thereof is chamfered so that it slopes radially inward as described above.

Figure 7:
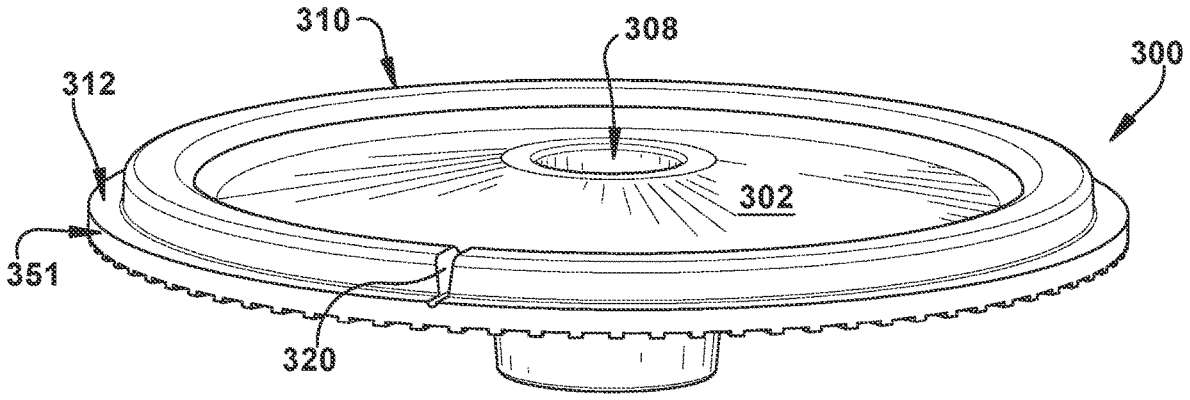
FIG. 7 is a side perspective view of an intermediate body of a gas burner assembly, according to the first embodiment.
Figure 8:
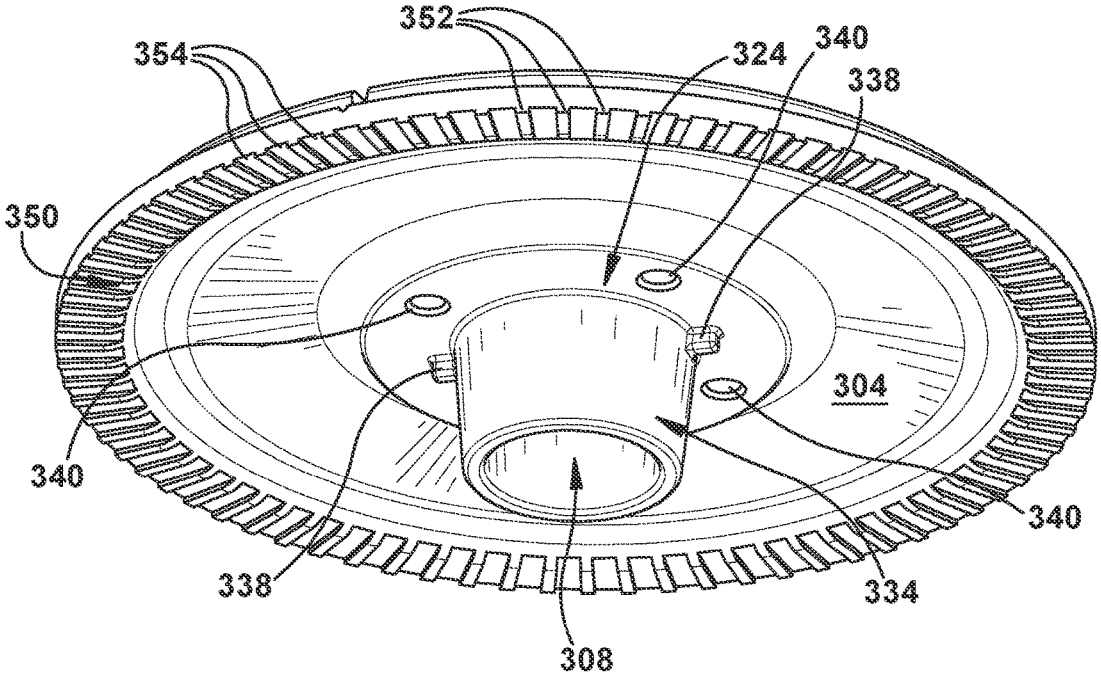
FIG. 8 is a bottom perspective view of the intermediate body of FIG. 7.

Referring to FIG. 7, the intermediate body 300 (according to the first embodiment) is a generally disc-shaped element having an upper surface 302 and a lower surface 304 (FIG. 8). The upper surface 302 is frustoconically contoured to slope downwardly from a location adjacent a first opening 308 of the intermediate body 300, toward a raised annular band 310 that extends about and adjacent a periphery of the intermediate body 300. The raised annular band 310 is spaced inwardly from an outer circumferential edge 351 of the intermediate body 300 to define an annular ledge 312. A slot 320 is formed in the annular band 310. In the embodiment shown, a base portion of the slot 320 is formed in an upper portion of the annular ledge 312.

Referring to FIG. 8, a boss 334 extends from the lower surface 304 of the intermediate body 300, and the first opening 308 extends through the boss 334. The first opening 308 has a diameter that increases from a first diameter at the upper surface 302 (FIG. 7) of the intermediate body 300 to a second, larger diameter at a bottom or distal end of the boss 334, such that the first opening 308 converges upward. The lower surface 304 may include a lower annular portion 324 surrounding the boss 334. The lower annular portion 324 stands proud of the surrounding portion of the lower surface 304.

A plurality of protrusions 338 are formed at a junction of the lower annular portion 324 and the boss 334. In the illustrated embodiment, two of the protrusions 338 are shown, and one of the protrusions 338 is eclipsed by the boss 334. It is contemplated that the protrusions 338 may be different in number and in location. The protrusions 338 are dimensioned and positioned to engage the notches 212 (FIG. 5) formed around the pass-through opening 208 of the lower body 200, as described in detail below. Bores 340 extend into the lower surface 304 and are configured to receive fasteners (not shown), as described in detail below.

A plurality of radial slots 354 are formed along a lower peripheral annulus 350 of the intermediate body 300. Each slot 354 is defined by a pair of adjacent, rectangular-shaped cogs or standoffs 352 that extend radially and protrude downwardly from the lower peripheral annulus 350. Alternatively, the slots 354 may be formed by machining grooves into the lower peripheral annulus 350. In the illustrated embodiment, the slots 354 are square-shaped. It is contemplated that the slots 354 could have other shapes, for example, but not limited to, U-shaped, V-shaped, etc. In the embodiment shown, the slots 354 extend along straight radial lines. It is contemplated that the slots 354 may be skewed or curved. It is also contemplated that the slots 354 could be different in number and location.

Figure 9:
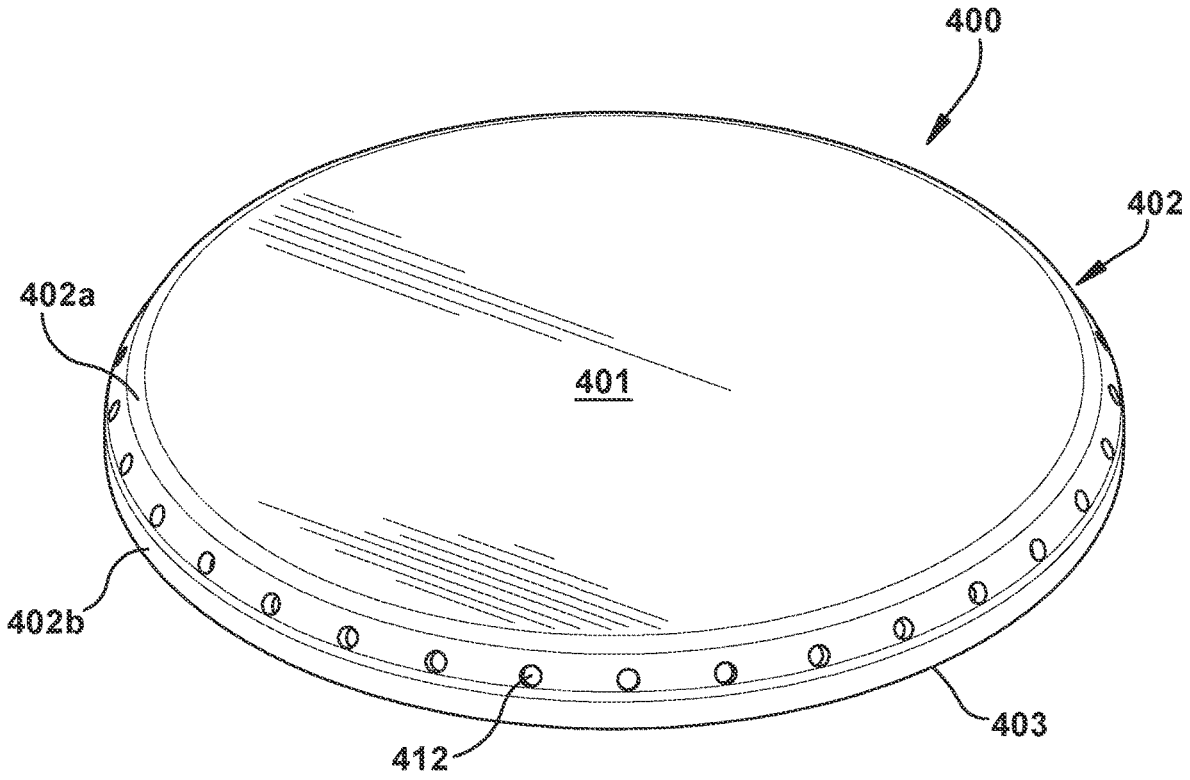
FIG. 9 is a top perspective view of a cap of the gas burner assembly of FIG. 2.

Referring to FIG. 9, the cap 400 includes a top planar wall 401 and a downwardly extending peripheral side wall 402 having a sloped upper portion 402*a* and a vertical lower portion 402*b*. A plurality of first gas burner ports 412 are disposed in the sloped upper portion 402*a*. In the embodiment shown, the first gas burner ports 412 are illustrated as circular burner ports. It is contemplated that the first gas burner ports 412 could be defined by other shapes, for example, but not limited to, U-shaped openings, rectangular openings, or slanted slits, etc.

Referring to FIGS. 10-14 a second embodiment will be described. The second embodiment is essentially the same as the first embodiment with the changes noted below.

Figure 11:
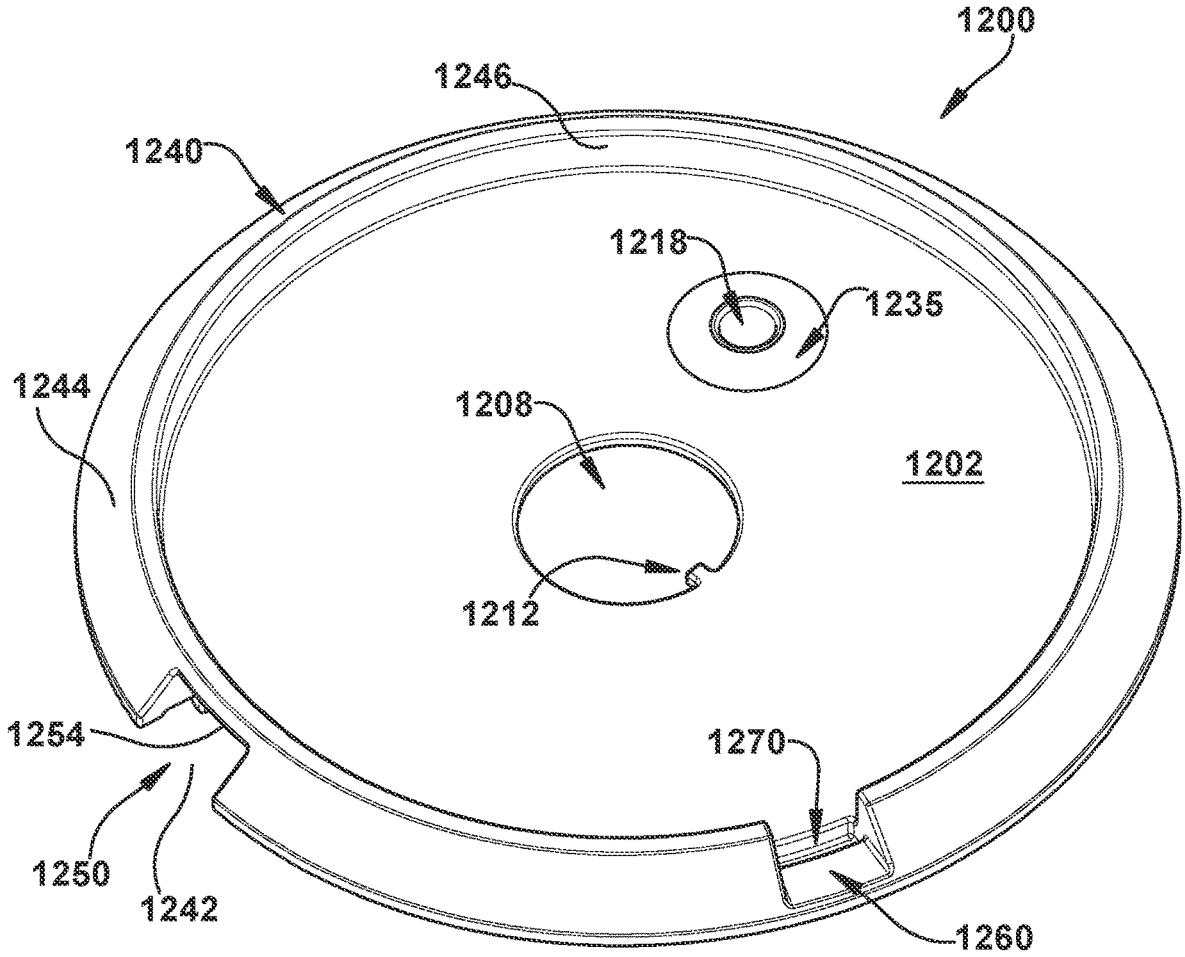
FIG. 11 is a top perspective view of a lower body of a gas burner assembly according to the second embodiment.
Figure 12A:
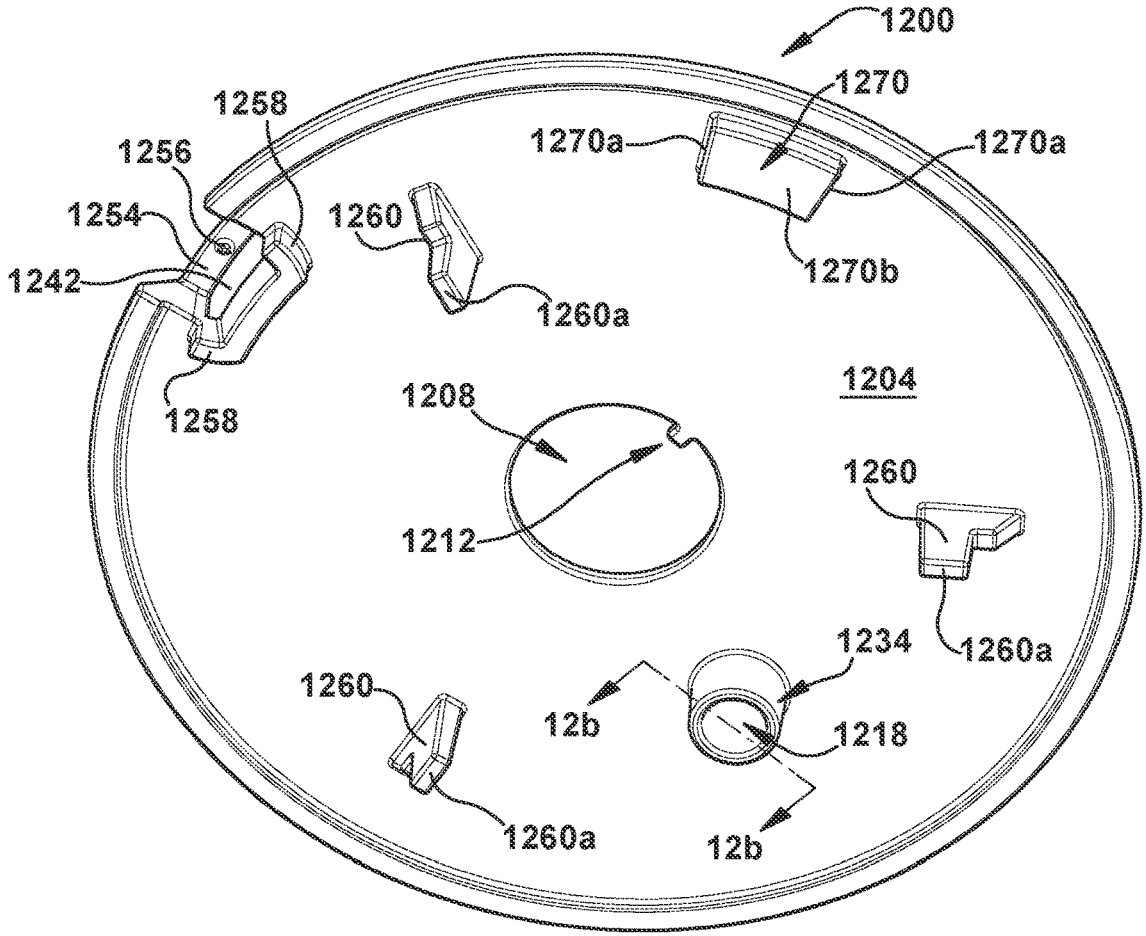
FIG. 12*a* is a bottom perspective view of the lower body of FIG. 11.
Figure 12B:
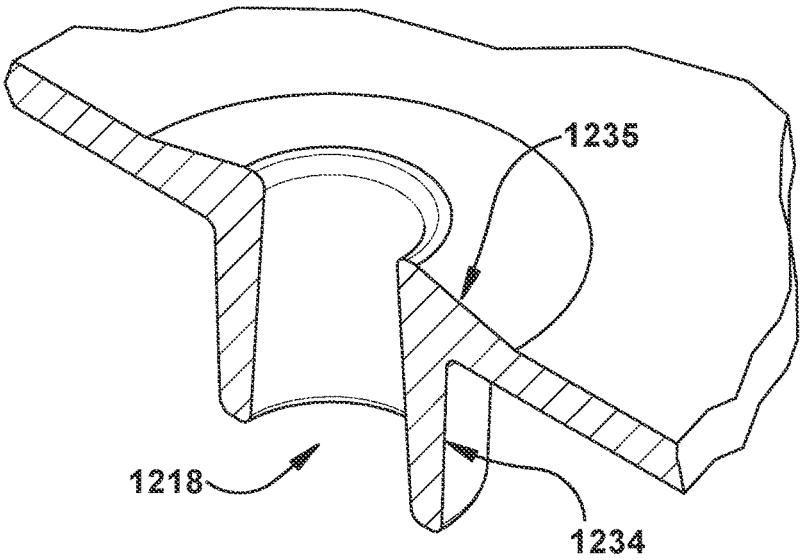
FIG. 12*b* is a closeup section view of a boss extending from a lower surface of the lower body of FIG. 11 taken along line 12*b*-12*b* of FIG. 12*a;*

Referring to FIGS. 11, 12*a* and 12*b*, the lower body 1200 shares some similarities with the lower body 200 of the first embodiment, and similar reference numbers (+1000) will be used for similar components. The lower body 1200 includes an upper surface 1202, a lower surface 1204, and a pass-through opening 1208 extending through a central portion of the lower body 1200 between the upper surface 1202 and the lower surface 1204. A protrusion 1212 may extend into the pass-through opening 1208 from an outer periphery of the pass-through opening 1208. In the illustrated embodiment, there is a single protrusion 1212. It is contemplated that the protrusion 1212 may be different in shape, number, and location.

A boss 1234 extends from the lower surface 1204 of the lower body 1200, and a secondary opening 1218 of the lower body 1200 extends through the boss 1234 to the upper surface 1202. In the embodiment shown, the secondary opening 1218 is radially offset relative to the pass-through opening 1208 of the lower body 1200. Referring to FIG. 12*b*, the secondary opening 1218 may be substantially frustoconical such that its interior diameter generally decreases from the lower end of the boss 1234 to its upper end where the opening 1218 opens to the upper surface 1202. A portion 1235 of the upper surface 1202 around the upper end of the opening 1218 is raised relative to the adjacent portion of the upper surface 1202 and has a conical-shape surrounding the opening 1218.

Figure 13:
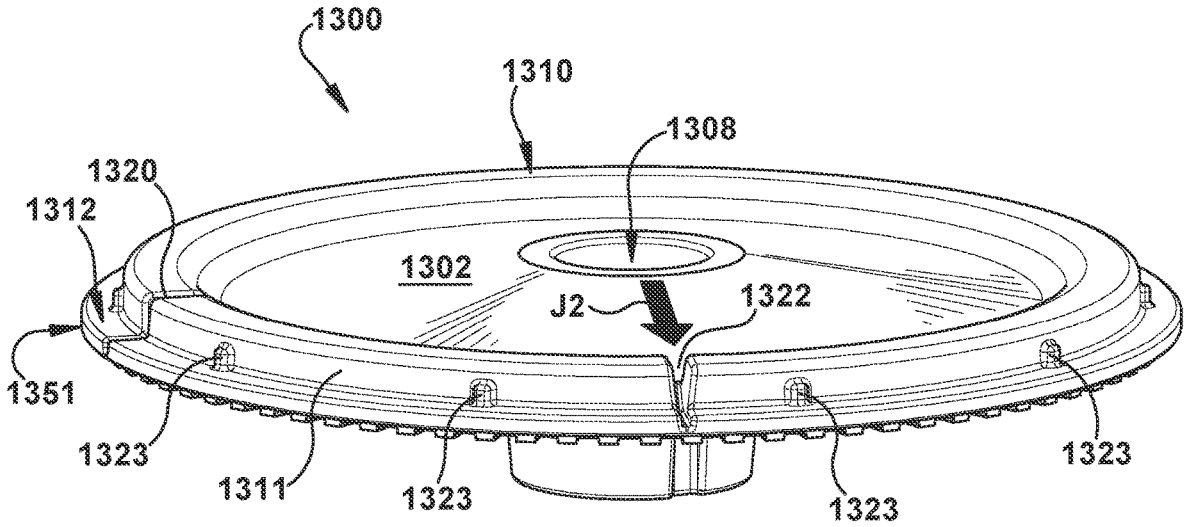
FIG. 13 is a side perspective view of an intermediate body of a gas burner assembly, according to the second embodiment.
Figure 14:
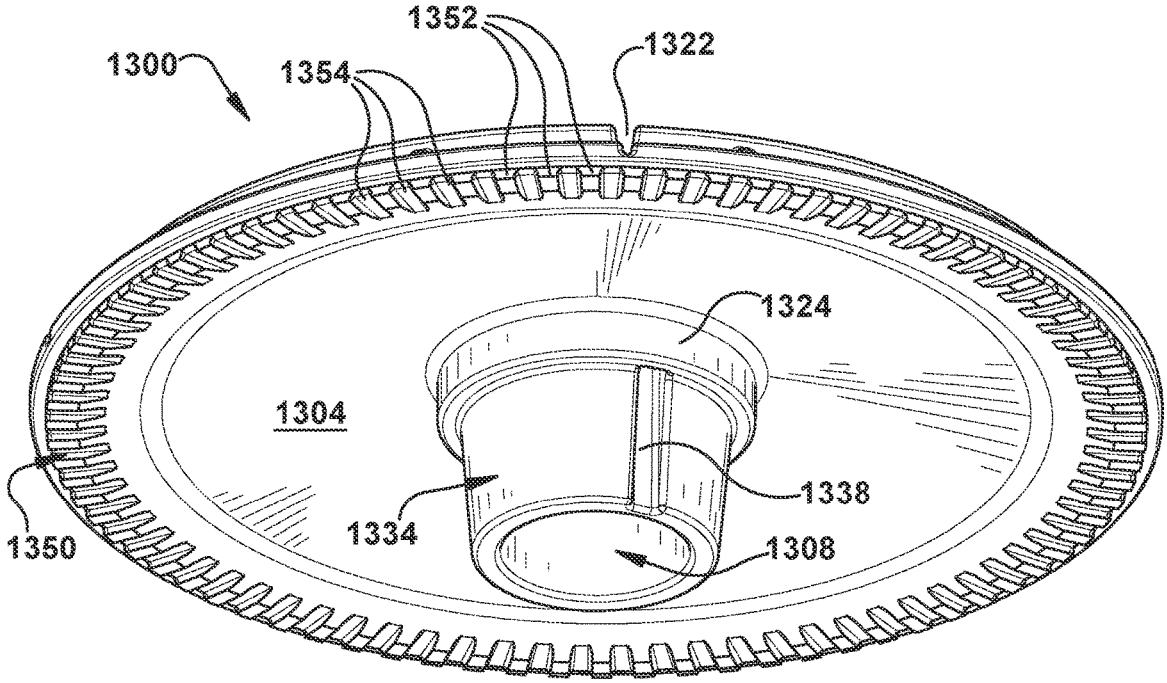
FIG. 14 is a bottom perspective view of the intermediate body of FIG. 13.

Referring to FIGS. 13 and 14, the intermediate body 1300 according to the second embodiment is illustrated. The intermediate body 1300 shares similarities with the intermediate body 300 of the first embodiment, and similar reference numbers (+1000) will be used for similar components.

The intermediate body 1300 is a generally disc-shaped element having an upper surface 1302 and a lower surface 1304. A raised annular band 1310 is spaced inwardly from an outer circumferential edge 1351 of the intermediate body 1300 to define an annular ledge 1312. A first slot 1320 is formed in the annular band 1310. In the embodiment shown, a base portion of the first slot 1320 is formed in an upper portion of the annular ledge 1312. The first slot 1320 is positioned, as described in detail below. A second slot 1322 is also formed in the annular band 1310. In the embodiment shown, a base portion of the second slot 1322 is formed in the upper portion of the annular ledge 1312. The second slot 1322 is positioned, as described in detail below.

A plurality of protrusions 1323 are formed at a junction of the annular ledge 1312 and the annular band 1310. In the illustrated embodiment, the protrusions 1323 are generally square-shaped and extend radially and protrude outwardly from an outer vertical wall 1311 of the annular band 1310. It is contemplated that the protrusions 1323 could have other shapes, for example, but not limited to, round, V-shaped, etc.

Referring to FIG. 14, a boss 1334 extends from the lower surface 1304 of the intermediate body 1300, and the first opening 1308 extends through the boss 1334. A groove 1338 is formed into an outer surface of the boss 1334 and extends axially along the boss 1334. It is contemplated that the groove 1338 may be machined into the boss 1334 via a slot or end milling process. The groove 1338 is positioned and dimensioned, as described in detail below. The lower surface 1304 may include an annular ledge 1324 surrounding the boss 1334. The annular ledge 1324 stands proud of the surrounding portion of the lower surface 1304.

Referring to FIGS. 3 and 15, the gas burner assembly 100 will now be described in relation to mounting the gas burner assembly 100 (according to the first embodiment) to the cooktop panel 52. Assembly of the gas burner assembly 100 includes securing the orifice holder 110 to the substructure (not shown) of the range 50 (FIG. 1) via fasteners (not shown) that extend through the mounting holes 124 of the orifice holder 110. In this manner, a portion 53 of the cooktop panel 52 may be seated on the recessed ledge 123 of the orifice holder 110 for concealing the mounting holes 124 of the orifice holder 110. In another embodiment, fasteners may extend through holes (not shown) in the cooktop panel 52 that are aligned with the mounting holes 124 of the orifice holder 110 for securing the orifice holder 110 to the cooktop panel 52. A first fuel supply line (not shown) is connected to the first gas inlet port 160, and a second fuel supply line (not shown) is connected to the second gas inlet port 162, respectively.

The intermediate body 300 may be secured to the lower body 200 to create a subassembly or lower stack of the gas burner assembly 100. The subassembly will be described herein with reference to the assembly of the intermediate body 300 of the first embodiment and the lower body 200 of the first embodiment. The assembly of intermediate body 1300 of the second embodiment and the lower body 1200 of the second embodiment is similar, except as noted below. The intermediate body 300 may be placed on the lower body 200 such that the boss 334 of the intermediate body 300 extends through the pass-through opening 208 of the lower body 200. In this respect, the boss 334 and the pass-through opening 208 are dimensioned and positioned to axially align with each other along a central axis CA of the gas burner assembly 100.

Figure 17:
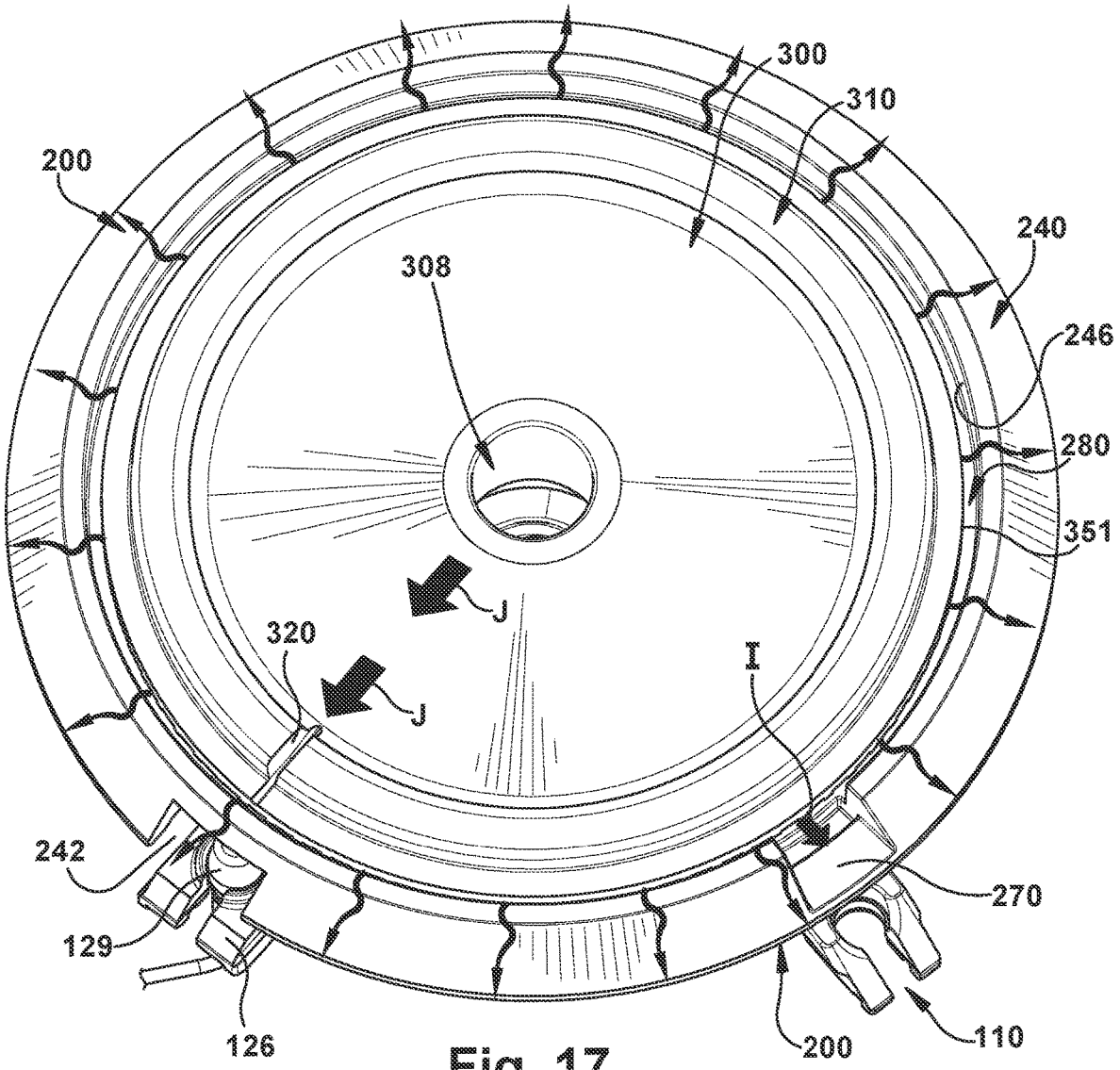
FIG. 17 is a top perspective view illustrating the intermediate body resting on the lower body and the orifice holder of the gas burner assembly.

As the intermediate body 300 is placed on the lower body 200, the protrusions 338 (FIG. 8) of the intermediate body 300 are positioned and dimensioned to align with the notches 212 (FIG. 5) in the lower body 200. In particular, the protrusions 338 (FIG. 8) and the notches 212 (FIG. 5) are configured such that the rotational orientation of the intermediate body 300 is fixed relative to the lower body 200. As shown in FIG. 17, the cooperation between the protrusions 338 and the notches 212 also serves to align the slot 320 in the intermediate body 300 with the spark ignitor 129 disposed in the tab 126 of the orifice holder 110.

Referring back to FIG. 15, when the intermediate body 300 of the first embodiment is seated on the lower body 200, the lower surface 304 of the intermediate body 300 rests against the upper surface 202 of the lower body 200 to define a lower chamber 500 of the gas burner assembly 100. In particular, the raised annular portion 210 of the upper surface 202 is pressed against the lower annular portion 324 of the lower surface 304, and the lower peripheral annulus 350 of the lower surface 304 rests against the upper surface 202, respectively.

In the configuration illustrated, the slots 354 in the lower peripheral annulus 350 of the intermediate body 300 and the upper surface 202 of the lower body 200 define second gas burner ports 360 of the gas burner assembly 100. It should be understood that in other embodiments, the slots 354 and the peripheral annulus 350 may be formed along the upper surface 202 of the lower body 200 for defining the second gas burner ports 360 when the intermediate body 300 rests on the lower body 200. In this manner, it should also be appreciated that the standoffs 352 (FIG. 8) of the intermediate body 300 may be formed on the upper surface 202 of the lower body 200. In the embodiment shown, the secondary opening 218 of the lower body 200 defines an inlet to the lower chamber 500 of the gas burner assembly 100. Fasteners (not shown) may extend through the mounting holes 214 (FIG. 5) formed in the lower body 200 and into the corresponding bores 340 (FIG. 8) formed in the lower surface 304 of the intermediate body 300, respectively, for securing the intermediate body 300 to the lower body 200.

The subassembly composed of the lower body 200 and the intermediate body 300 is positioned on the orifice holder 110. In particular, the legs 206 extending from the lower surface 202 of the lower body 200 are dimensioned and positioned to align with and be received/seated in the seats 116 formed in the orifice holder 110. When the lower body 200 is positioned on the orifice holder 110, the legs 206 are dimensioned such that the lower surface 204 of the lower body 200 is spaced above the upper surface of the cooktop panel 52 to define a circumferential air inlet 392 therebetween.

As shown in FIG. 17, the lower body 200 is placed on the orifice holder 110 in a specific rotational orientation such that the slot 320 in the intermediate body 300 and the opening 242 in the flange 240 of the lower body 200 align with the spark ignitor 129 disposed in the tab 126 of the orifice holder 110. In this respect, the opening 242 defined by the first notch 250 in the flange 240 is dimensioned to accommodate the spark ignitor 129 therein. In this orientation, and referring back to FIG. 15, the first gas nozzle 141 aligns with the first opening 308 in the intermediate body 300, and the second gas nozzle 143 aligns with the secondary opening 218 in the lower body 200, respectively. When assembled this way, the contoured bowl 114 of the orifice holder 110 defines a mixing volume or mixing chamber 390 of the gas burner assembly 100.

The cap 400 is placed on the intermediate body 300 to define an upper chamber 600 of the gas burner assembly 100. In particular, the upper chamber 600 is defined by the top planar wall 401 and the peripheral side wall 402 of the cap 400, and the upper surface 302 of the intermediate body 300. Together, the intermediate body 300 and the cap 400 also embody an upper stack of the gas burner assembly 100. In this configuration, a distal end 403 of the peripheral side wall 402 is dimensioned to rest on the annular ledge 312 formed on the intermediate body 300. Additionally, the first opening 308 in the intermediate body 300 defines an inlet to the upper chamber 600 of the gas burner assembly 100.

As noted above, the assembly of the second embodiment is similar in most respects to the first embodiment, except for the differences noted below.

Figure 10:
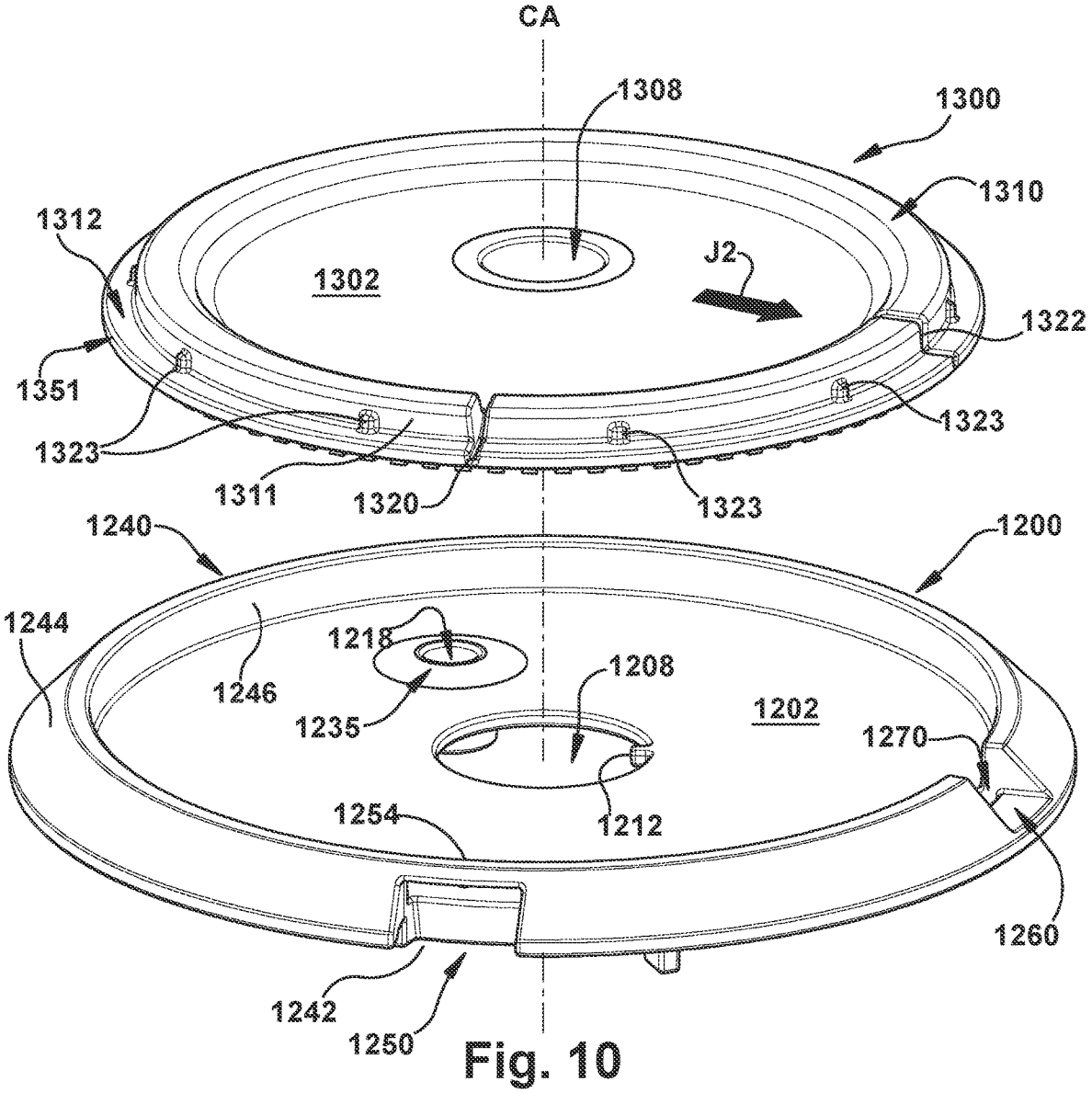
FIG. 10 is an exploded, perspective view similar to FIG. 3, but illustrating only an intermediate body and a lower body according to a second embodiment.

Referring to FIG. 10, in the second embodiment the intermediate body 1300 is placed on the lower body 1200 such that the groove 1338 (FIG. 14) of the intermediate body 1300 aligns with the protrusion 1212 of the lower body 1200. The groove 1338 (FIG. 14) and the protrusion 1212 are configured such that the rotational orientation of the intermediate body 1300 is fixed relative to the lower body 1200. As shown in FIG. 10, the cooperation between the groove 1338 (FIG. 14) and the protrusion 1212 also serves to align the first slot 1320 in the intermediate body 1300 with the opening 1242 formed in the flange 1240 of the lower body 1200 and to align the second slot 1322 in the intermediate body 1300 with the second notch 1260 that is positioned above the stability chamber 1270.

Referring to FIG. 10, when the intermediate body 1300 is seated on the lower body 1200, the annular ledge 1324 (FIG. 14) of the intermediate body 1300 rests against the upper surface 1202 of the lower body 1200. In the second embodiment, the intermediate body 1300 and the lower body 1200 are illustrated as not including fasteners to secure the respective bodies 1200, 1300 together.

When the cap 400 (FIG. 9) is placed on the intermediate body 1300 of the second embodiment, the plurality of protrusions 1323 on the intermediate body 1300 engage an inner surface of the peripheral side wall 402 (FIG. 9) to center the cap 400 (FIG. 9) on the intermediate body 1300. In this respect, the plurality of protrusions 1323 may help reduce movement of the cap 400 (FIG. 9) when it is fitted on the intermediate body 1300.

Referring to FIG. 15, the gas burner assembly 100 will now be described with respect to operation of the same. In particular, the operation will be described relative to the gas burner assembly 100 including the orifice holder 110, the lower body 200, the intermediate body 300 and the cap 400. The operation of the gas burner assembly 100 including the lower body 1200 and the intermediate body 1300 is similar to the operation of the gas burner assembly 100 with the lower body 200 and the intermediate body 300, except where noted below. When fuel (e.g., a combustible gas such as natural gas) is supplied to the first gas inlet port 160, it passes through the first internal passage 161 and enters the mixing chamber 390 via the first gas nozzle 141 along flow path A. Gas exiting the first gas nozzle 141 is ejected into the mixing chamber 390 toward the first opening 308 of the intermediate body 300. As the gas flows from the mixing chamber 390 into a throat of the first opening 308 at the lower end of the boss 334, combustion air is drawn into the mixing chamber 390 from a surrounding environment along flow path B via the circumferential air inlet 392, and induced to flow together with the combustion gas via a Venturi effect into the first opening 308. The air mixes with the fuel to form a first air-fuel mixture on entering the first opening 308. The first air-fuel mixture is supplied to the upper chamber 600 via the inlet of the upper chamber 600 along flow path C through the first opening 308 in boss 334. The first air-fuel mixture exits the upper chamber 600 along flow path D via the first gas burner ports 412 of the gas burner assembly 100, whereupon it is combusted to yield main flames emanating from-the first burner ports 412.

Referring to FIG. 17, a portion of the first-air fuel mixture in the upper chamber 600 (FIG. 15) flows along flow path J through the slot 320 formed in the intermediate body 300. This portion of the first air-fuel mixture is directed toward the spark ignitor 129 disposed in the tab 126 of the orifice holder 110. Referring back to FIG. 16, the spark ignitor 129 (not shown in FIG. 16 for clarity) ignites the first air-fuel mixture by directing a spark to the spark target 256 to form a main flame emanating from the first gas burner ports 412 and about the peripheral side wall 402 of the cap 400. In this respect, the first gas burner ports 412 are also referred to as main burner ports of the gas burner assembly 100.

Figure 16:
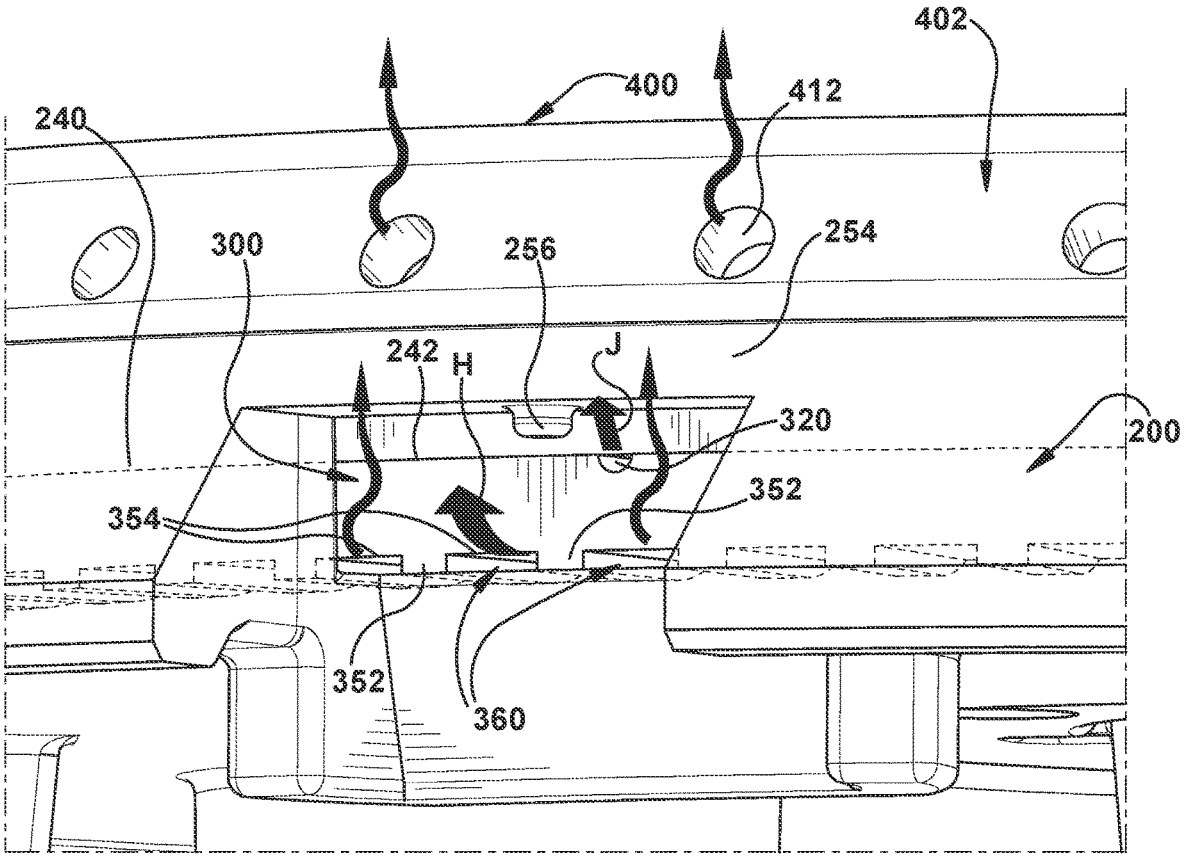
FIG. 16 is an enlarged perspective view of a notch formed in a flange of the lower body of FIG. 5.

Referring back to FIG. 15, fuel is supplied to the second gas inlet port 162, and passes through the second internal passage 163 and enters the mixing chamber 390 via the second gas nozzle 143 along flow path E, toward a throat of the secondary opening 218 in lower body 200, at a lower end of the boss 234. Fuel exiting the second gas nozzle 143 is ejected into mixing chamber 390 toward the secondary opening 218. Similarly as above for the first gas nozzle 141, the fuel stream exiting the second gas nozzle 143 draws combustion air into the mixing chamber 390 along flow path B via the circumferential air inlet 392, and into the throat of the secondary opening 218 via a Venturi effect where the fuel mixes with combustion air to form a second air-fuel mixture. The second air-fuel mixture is supplied to the lower chamber 500 via the inlet of the lower chamber 500 along flow path F, through the secondary opening 218 in the boss 234-. The second air-fuel mixture exits the lower chamber 500 along flow path G via the second gas burner ports 360 of the gas burner assembly 100. Referring to FIG. 16, a portion of the second air-fuel mixture exiting the second gas burner ports 360 flows through the opening 242 in the flange 240 along flow path H toward the spark target 256 disposed on the bottom surface of the bridge 254. The spark ignitor 129 (FIG. 17) ignites the second air-fuel mixture by directing a spark at the spark target 256 to form a "curtain or simmer flame" emanating from the second burner ports 360 of the gas burner assembly 100. In this respect, the second gas burner ports 360 are also referred to as simmer burner ports of the gas burner assembly 100.

Referring to FIG. 17, the curtain flame is formed substantially about an annular recess 280 located between the inner-wall 246 of the flange 240 of the lower body 200 and the circumferential edge 351 of the intermediate body 300. Another portion of the second air-fuel mixture is directed along flow path I toward the stability chamber 270. This portion of the second air-fuel mixture fills the stability chamber 270 and creates a separate stability flame (not shown), described in detail below.

Referring back to FIG. 15, in normal operation, the composition and pressure of the second air-fuel mixture will be equal in both the stability chamber 270 and the lower chamber 500. Accordingly, the stability chamber 270 and the second gas burner ports 360 will be fed continuously to sustain their respective flames. However, because the gas burner assembly 100 is a top-breather that draws combustion air from the ambient environment, momentary or transient pressure waves resulting from activities in the room may impact the supply of combustion air to the circumferential air inlet 392 of the gas burner assembly 100, especially at low turn-down. For example, opening or closing a door or activation of an HVAC system may generate instantaneous pressure waves sufficient to disrupt the flow of combustion air so as to extinguish flames.

The stability chamber 270 is at least partially isolated from the remaining lower chamber 500 such that the aforementioned pressure wave is impeded from impacting the composition and pressure of the second air-fuel mixture in the stability chamber 270), and therefore the instantaneous flow characteristics of the second air-fuel mixture resident in the stability chamber 270. In addition, the stability chamber 270 stores a small excess of the combustion mixture (not shown), which may continue burning during transient pressure effects that otherwise will extinguish the flames (FIG. 16) emanating from the first gas burner ports 412 and the second gas burner ports 360. As a result, combustion of the second air-fuel mixture to produce the stability flame from the stability chamber 270 may be substantially unaffected by instantaneous, transient pressure waves that may otherwise 'blow out' the flames emanating from the second gas burner ports 360 and the first gas burner ports 412. Thereafter, once the instantaneous, transient pressure waves have passed, the stability flame sustained in the stability chamber 270 may help reignite the first air-fuel mixture exiting the first gas burner ports 412 and the second air-fuel mixture exiting the second gas burner ports 360 resulting in substantially uninterrupted flame performance.

Figure 18:
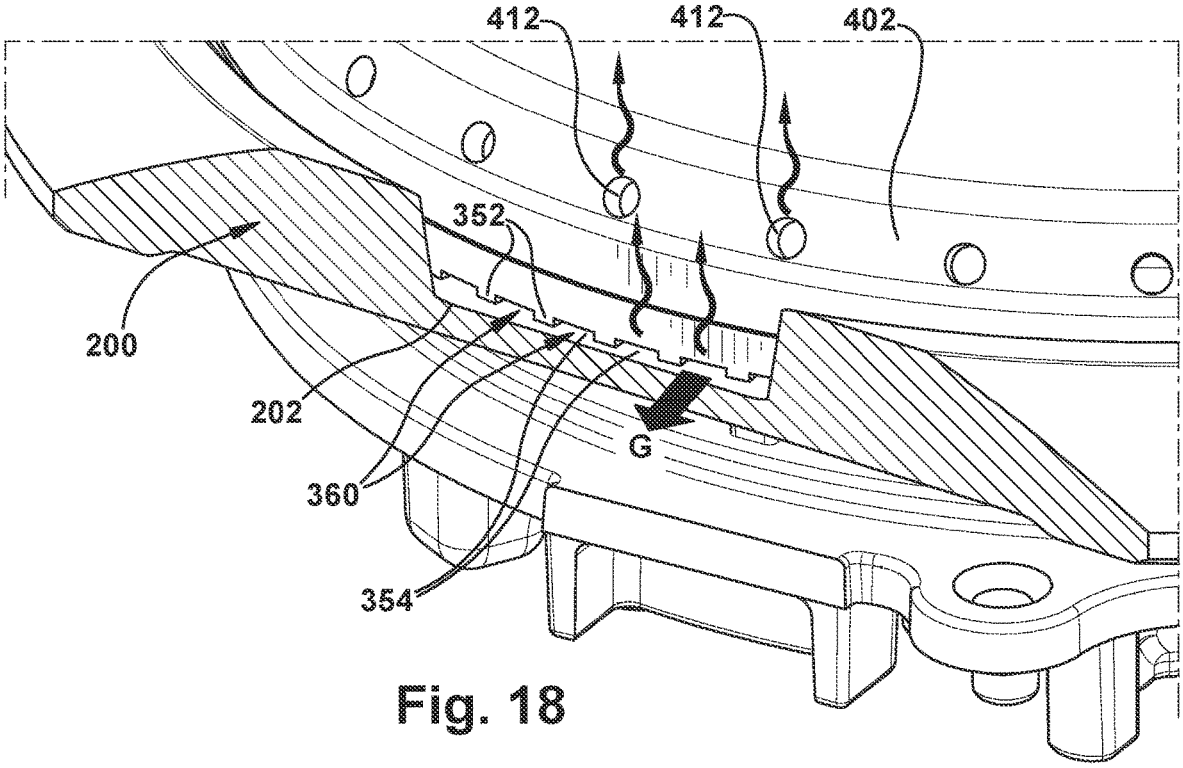
FIG. 18 is an enlarged perspective section view of the gas burner assembly of FIG. 2 taken along line 18-18 of FIG. 2.

Referring to FIG. 18, during the reignition of the second gas burner ports 360, the curtain flame emanating from the second gas burner ports 360 spans the peripheral side wall 402 of the cap 400 to reignite the first gas burner ports 412. In this manner, the curtain flame serves as a retention flame that helps reignite the main flame during a "blow-out," as explained above. More specifically, the curtain flame spans the peripheral side wall 402 and "carries" the flame from one gas burner port 412 to adjacent gas burner ports 412. It is contemplated that the curtain flame may be continuous about the entire periphery of the cap 400 or the curtain flame may be segmented and exist only between adjacent first gas burner ports 412.

Figure 19:
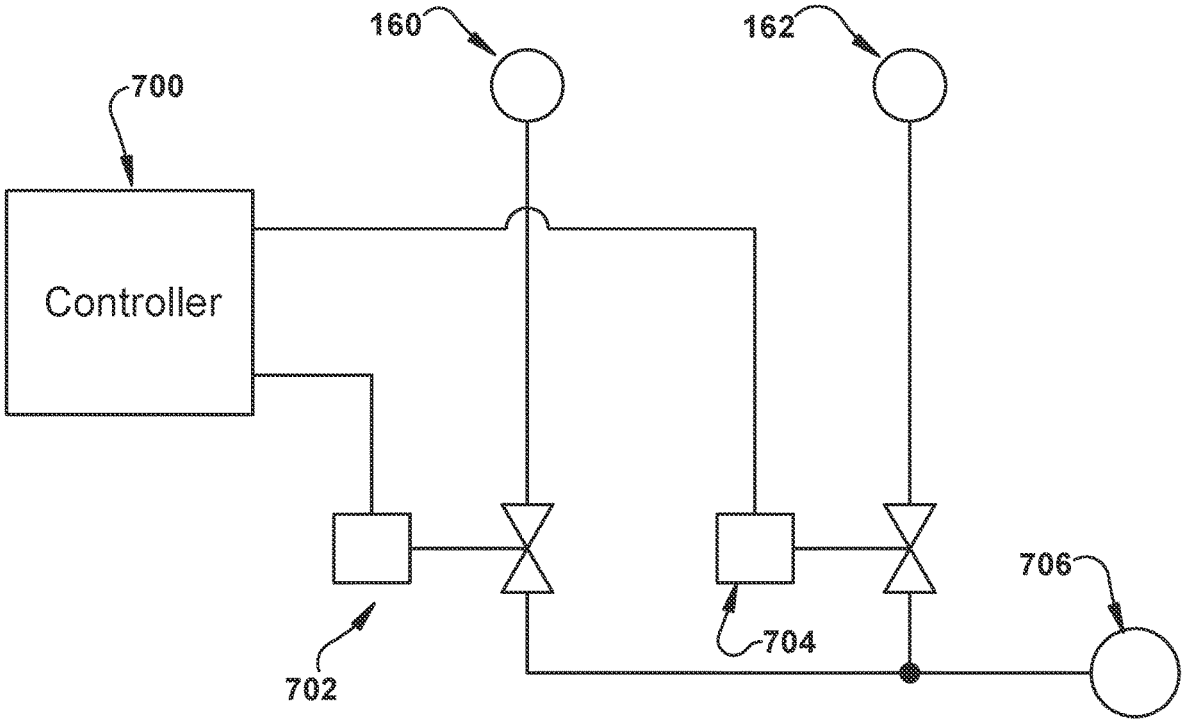
FIG. 19 is a schematic diagram illustrating a valve arrangement for the gas burner assembly of FIG. 2.

Referring to FIGS. 15 and 19, a controller 700 may control a first valve 702 and a second valve 704 for supplying fuel from a source 706 to the first gas inlet port 160 and the second gas inlet port 162, respectively. In particular, the supply of fuel to each of the gas inlet ports 160 and 162 may be selectively controlled by the first and the second valves 702 and 704. For example, the controller 700 may regulate the first valve 702 and the second valve 704 so that fuel may be supplied only to the first gas inlet port 160. In this mode of operation, gas is ejected only into the mixing chamber 390 via the first gas nozzle 141 located at the bottom of the bowl 114 in the orifice holder 110. Combustion air is drawn into mixing chamber 390 via a Venturi effect based on gas exiting the first gas nozzle 141 toward and into the throat of the first opening 308 to form the first air-fuel mixture that is supplied to the inlet of the upper chamber 600.

Similarly, when operating in a low power or simmer mode, the controller 700 may regulate the first valve 702 and the second valve 704 so that fuel is supplied only to the second gas inlet port 162. In this mode of operation, gas is ejected only into the mixing chamber 390 via the second gas nozzle 143 located at the bottom of the bowl 114 in the orifice holder 110. Combustion air is drawn into the mixing chamber 390 via a Venturi effect based on gas exiting the second gas nozzle 143 toward and into the throat of the secondary opening 218 to form the second air-fuel mixture that is supplied to the inlet of the lower chamber 500. The independent supply of the second air-fuel mixture to the lower chamber 500 is particularly beneficial when operating the second gas burner ports 360 at a low turn-down ratio. It should be understood that the controller 700 may regulate the valves 702, 704 so that fuel is supplied to the first gas inlet port 160 and the second gas inlet port 162 simultaneously, such as, for example, when forming a main flame via the first gas burner ports 412 and a curtain or retention flame via the second gas burner ports 360.

Because the controller 700 can selectively supply gas to the first gas inlet port 160 and the second gas inlet port 162, it is contemplated that the intensity of the flames exiting the first gas burner ports 410 and the second gas burner ports 360 can be separately varied and/or independently operated, as described above.

As noted above, the operation of the second embodiment is similar to the operation of the first embodiment, except for the differences noted below.

Referring to FIG. 10, in the second embodiment wherein the gas burner assembly 100 includes the intermediate body 1300, a portion of the first-air fuel mixture in the upper chamber 600 (FIG. 15) flows along a flow path J2 through the second slot 1322 formed in the intermediate body 1300. This portion of the first air-fuel mixture is directed toward the stability chamber 1270 of the lower body 1200. As a result, combustion of the first air-fuel mixture to produce the stability flame from the stability chamber 1270 may be substantially unaffected by instantaneous, transient pressure waves that may otherwise 'blow out' the flames emanating from the second gas burner ports 360 and the first gas burner ports 412.

Illustrative embodiments have been described hereinabove. It should be appreciated that features of the first embodiment may be combined with features of the second embodiment. Therefore, the inventive concept, in its broader aspects, is not limited to the specific details and representations shown and described. It will be apparent to those skilled in the art that the above apparatuses and methods may incorporate changes and modifications without departing from the scope of this disclosure. The invention is therefore not limited to particular details of the disclosed embodiments, but rather encompasses the spirit and the scope thereof as embodied in the appended claims.

What is claimed is:

1. A gas burner assembly for a cooktop appliance, the gas burner assembly comprising:

an upper chamber;

a first plurality of burner ports communicating with the upper chamber;

a lower chamber isolated from the upper chamber;

a second plurality of burner ports communicating with the lower chamber;

a first fuel-gas injector configured to direct a first stream of fuel gas into a first opening that communicates with the upper chamber, thereby drawing surrounding air to be combined therewith in said first opening to yield injection of a first mixture of fuel gas and air into the upper chamber, to flow out the first plurality of burner ports;

a second fuel-gas injector to direct a second stream of fuel gas into a secondary opening that communicates with the lower chamber, thereby drawing surrounding air to be combined therewith in said secondary opening to yield injection of a second mixture of fuel gas and air into the lower chamber, to flow out the second plurality of burner ports; and a mixing chamber; said first and secondary openings being in communication with said mixing chamber; said first fuel-gas injector being configured to direct said first stream of fuel gas through said mixing chamber into said first opening; said second fuel-gas injector being configured to direct said first stream of fuel gas through said mixing chamber into said secondary opening; the surrounding air drawn into each of said first and secondary openings being drawn from said mixing chamber, wherein the upper chamber is isolated from the lower chamber so that the first mixture of fuel gas and air in the upper chamber does not mix with the second mixture of fuel gas and air in the lower chamber.

2. The gas burner assembly according to claim 1, wherein a first flow path is defined from said first opening to said first plurality of burner ports and a second flow path is defined from said secondary opening to said second plurality of burner ports, wherein said first flow path does not intersect said second flow path, and wherein said first and second fuel-gas injectors are independently operable to independently regulate respective flow rates of said first and second mixtures of fuel gas and air through said first and second flow paths.

3. The gas burner assembly according to claim 1, further comprising a cap and an intermediate body, wherein the upper chamber is defined by a lower surface of the cap and an upper surface of the intermediate body.

4. The gas burner assembly according to claim 3, wherein the first plurality of burner ports are disposed about a peripheral side wall of the cap and in use a main flame emanates from the first plurality of burner ports.

5. The gas burner assembly according to claim 3, wherein the upper surface of the intermediate body includes a plurality of protrusions disposed adjacent a peripheral edge of the intermediate body configured to align the cap with the intermediate body.

6. The gas burner assembly according to claim 5, further comprising a slot formed in the upper surface of the intermediate body configured to supply a portion of the first mixture of fuel gas and air from the upper chamber to a stability chamber of the gas burner assembly.

7. The gas burner assembly according to claim 1, further comprising an intermediate body and a lower body, wherein the lower chamber is defined by a lower surface of the intermediate body and an upper surface of the lower body.

8. The gas burner assembly according to claim 7, wherein the second plurality of burner ports are defined between the intermediate body and the lower body.

9. A gas burner assembly for a cooktop appliance, the gas burner assembly comprising:

an upper chamber;

a first plurality of burner ports communicating with the upper chamber;

a lower chamber isolated from the upper chamber;

a second plurality of burner ports communicating with the lower chamber;

a first fuel-gas injector configured to direct a first stream of fuel gas into a first opening that communicates with the upper chamber, thereby drawing surrounding air to be combined therewith in said first opening to yield injection of a first mixture of fuel gas and air into the upper chamber, to flow out the first plurality of burner ports;

a second fuel-gas injector to direct a second stream of fuel gas into a secondary opening that communicates with the lower chamber, thereby drawing surrounding air to be combined therewith in said secondary opening to yield injection of a second mixture of fuel gas and air into the lower chamber, to flow out the second plurality of burner ports; and an intermediate body and a lower body, wherein the lower chamber is defined by a lower surface of the intermediate body and an upper surface of the lower body, wherein the upper chamber is isolated from the lower chamber so that the first mixture of fuel gas and air in the upper chamber does not mix with the second mixture of fuel gas and air in the lower chamber, and wherein a plurality of standoffs are formed on the lower surface of the intermediate body to define the second plurality of burner ports when the intermediate body rests on the lower body.

10. The gas burner assembly of claim 7:

the lower body comprising a pass-through opening and said secondary opening between the upper surface and a lower surface of the lower body;

the intermediate body resting on the lower body and comprising said first opening between an upper surface and the lower surface of the intermediate body, said first opening extending through said pass-through opening in the lower body.

11. The gas burner assembly according to claim 10, wherein said pass-through opening in the lower body and the first opening of the intermediate body are disposed along a central axis of the gas burner assembly, and said secondary opening in the lower body is offset from the central axis.

12. The gas burner assembly according to claim 10, wherein at least a portion of the secondary opening is frustoconical.

13. The gas burner assembly according to claim 12, wherein a portion of the secondary opening includes a chamfered wall.

14. The gas burner assembly according to claim 10, wherein the intermediate body includes a central boss extending from the lower surface thereof and through the pass-through opening of the lower body, said first opening extending through said central boss.

15. The gas burner assembly according to claim 14, wherein at least one of the central boss of the intermediate body and the pass-through opening in the lower body includes a notch or groove configured to receive a protrusion formed on the other of the central boss of the intermediate body and the pass-through opening of the lower body in a manner that constrains the lower body and the intermediate body from relative rotation when engaged.

16. An appliance having a cooktop panel and the gas burner assembly of claim 1 mounted at the cooktop panel, wherein in use the first stream of fuel gas and the second stream of fuel gas each draws the surrounding air into the respective first and secondary openings from above the cooktop panel.

17. An appliance having a cooktop panel and a gas burner assembly mounted on the cooktop, the gas burner assembly comprising:

a lower body comprising a pass-through opening and a secondary opening extending between an upper surface and a lower surface of the lower body;

an intermediate body resting on the lower body, the intermediate body comprising a first opening extending between an upper surface and a lower surface of the intermediate body, the first opening of the intermediate body being aligned with the pass-through opening of the lower body, the lower surface of the intermediate body and the upper surface of the lower body at least partially defining a lower chamber of the gas burner assembly, the secondary opening of the lower body defining an inlet to the lower chamber, and at least one of the lower body and the intermediate body defining a simmer burner port fluidly communicating with the lower chamber; and a cap positioned on the intermediate body, the cap comprising a top planar wall and a peripheral side wall including a main burner port of the gas burner assembly;

the top planar wall and the peripheral side wall of the cap and the upper surface of the intermediate body defining an upper chamber of the gas burner assembly, the first opening of the intermediate body defining an inlet to the upper chamber, and the main burner port fluidly communicating with the upper chamber, wherein the lower surface of the lower body is spaced from an upper surface of the cooktop panel to define a circumferential air inlet to a mixing chamber fluidly connected to both the upper chamber and the lower chamber, and wherein in use fuel exiting a first gas port connected to the mixing chamber is mixed with air drawn into the mixing chamber through the circumferential air inlet to form a first air-fuel mixture that is supplied to the inlet of the upper chamber, and in use fuel exiting a second gas port connected to the mixing chamber is mixed with the air drawn into the mixing chamber through the circumferential air inlet to form a second air-fuel mixture that is supplied to the inlet of the lower chamber.

18. The appliance according to claim 17, further comprising a first valve and a second valve connected to the first gas port and the second gas port, respectively, for selectively suppling fuel to the first gas port and the second gas port.

* * * * *